United States Patent [19]

Koontz

[11] 4,049,471

[45] Sept. 20, 1977

[54] TECHNIQUE FOR STABILIZING CONTACT RESISTANCE OF GOLD PLATED ELECTRICAL CONTACTS

[75] Inventor: Donald Eldridge Koontz, Summit, N.J.

[73] Assignee: Bell Telephone Laboratories, Incorporated, Murray Hill, N.J.

[21] Appl. No.: 708,553

[22] Filed: July 26, 1976

[51] Int. Cl.[2] ..... C22F 1/14

[52] U.S. Cl. ..... 148/13; 134/2; 134/3; 134/41; 148/20.6; 204/35 R; 204/37 R; 427/125; 427/352; 427/383 C; 427/444

[58] Field of Search ..... 148/13, 13.1, 20.6, 148/158, 28; 204/35 R, 37 R; 427/125, 352–354, 383 C, 444; 134/2, 3, 41

[56] References Cited

U.S. PATENT DOCUMENTS 3,314,827 4/1967 Vries ..... 148/20.6

*Primary Examiner*—R. Dean

*Attorney, Agent, or Firm*—Edward M. Fink

[57] ABSTRACT

A technique is described for stabilizing gold plated electrical contacts wherein the contacts are treated with an oxidizing agent at elevated temperatures, so resulting in a contact structure which does not evidence resistance drift during subsequent thermal aging. Additionally, the technique may be used to reduce the contact resistance of thermally aged contacts which were not subjected to the foregoing preparative process.

5 Claims, 2 Drawing Figures

TECHNIQUE FOR STABILIZING CONTACT RESISTANCE OF GOLD PLATED ELECTRICAL CONTACTS

This invention relates to a technique for the stabilization of electrical contacts. More particularly, the present invention relates to a technique for stabilizing the resistance of gold plated electrical contacts.

Gold plated contacts of diverse metals have been widely used in the electronics industry for many years with varying degrees of success. However, it has often been noted that the contact resistance of such contacts increases significantly upon exposure to elevated temperatures. It has been theorized that this limitation is occasioned by diffusion of organic materials co-deposited with the gold to the contact surfaces. Various techniques for obviating this difficulty have been attempted heretofore, typically involving electrolytic polishing. However, none have proven completely satisfactory for this purpose and investigative efforts have continued.

In accordance with the present invention, the prior art limitations have effectively been obviated by a novel technique wherein the contact of interest is treated with an oxidizing agent prior to or subsequent to thermal aging. Briefly, the inventive technique involves heating the contact at elevated temperatures in the presence of an oxidizing agent for a time period ranging from one to three minutes, so resulting in a contact structure which does not evidence resistance drift.

Figure 1:
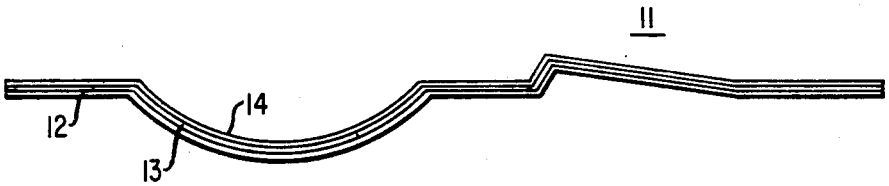
Figure 2:
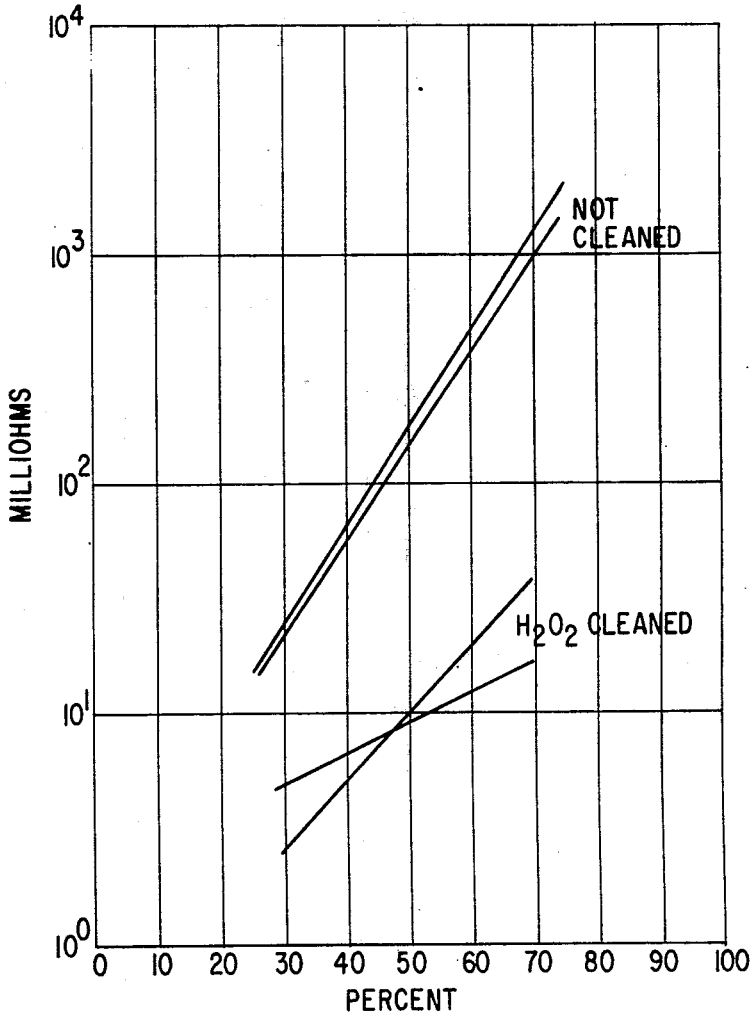

The invention will be more readily understood with reference to the following detailed description taken in conjuction with the accompanying drawing wherein:

FIG. 1 is a front elevational view in cross-section of a typical contact treated in accordance with the invention, and FIG. 2 is a graphical representation on coordinates of percent of contacts against contact resistance in milliohms showing contact resistance characteristics of connectors which were untreated or treated with an oxidizing agent prior to thermal aging.

With reference now more particularly to FIG. 1, there is shown a cross-sectional view of a typical electrical contact 11 suitable for use in the practice of the present invention. Contact 11 includes a refractory contact surface member 12 which may be comprised of tungsten, molybdenum, copper, copper-beryllium and other common binary alloys. Surface 12 is coated with a diffusion barrier 13, which may be comprised of nickel. Shown deposited upon barrier 13 is a thin film of gold having a thickness of the order of 100 microinches. The described contacts may be prepared in any conventional manner, as for example, punching or chemically etching from a sheet of metal or by cutting sections from rods and tumbling or burnishing, or chemically etching or polishing details to a desired degree of surface finish. Thereafter, a nickel plating operation may be employed to deposit the diffusion barrier. Finally, gold is deposited upon the diffusion barrier by electroplating or any conventional gold depositing process.

The contact so prepared is now ready for processing in accordance with the present invention. The oxidizing agent chosen for use herein may be selected from among those whose reduction products are water soluble. Typical agents suitable for this purpose include hydrogen peroxide, potassium, permangenate in acid media, chromates, vanadates and the like. The concentration of the agent chosen for this purpose may range from 1-5 percent by volume, the maximum being dictated by practical considerations. The minimum concentration is of course determined by the minimum amount required to produce the desired effect.

In the operation of the process the electrical contacts of interest are immersed in the oxidizing agent for a period of time ranging from 1-3 minutes while maintaining the oxidizing agent in a boiling condition. Following, the contacts are thoroughly rinsed with water and permitted to dry in air. Thereafter, the resistance of the contacts is measured, thermal aging conducted and resistance again measured.

Several examples of the present invention are set forth below. It will be understood by those skilled in the art that the exemplary embodiments are for the purposes of exposition only and are not to be construed as limiting. The contacts were copper-beryllium alloy contacts bearing nickel diffusion barriers of 150 $\mu$ inch thickness and 100 microinch surface of gold. The contacts were boiled for five minutes in a three percent hydrogen peroxide solution, water rinsed and air dried. The contact resistance was measured prior to aging with three readings being taken per contact at 10 grams force using a 20 mil diameter gold wire probe. Initial contact resistance values were in the 2 to 4 milliohm range.

The contacts were than placed in covered Pyrex dishes and oven aged with a horizontal air flow for one week at 150° C. Following, contact resistance was again measured.

With reference now to FIG. 2, there is shown a graphical representation on coordinates of percent of the contacts against contact resistance in milliohms showing resistance after aging of contacts prepared in accordance with the invention and those not subjected to the described oxidizing agent. The two curves designated A and B represent combined data for contacts not treated in accordance with the invention whereas curves C and D represent data for treated contacts. As noted in FIG. 2, the median contact resistance for the treated samples is approximately twenty times lower than the median for the uncleaned samples. The results clearly indicate the initial contaminants present in the contacts have no affect on contact resistance prior to aging but during thermal aging is transformed into a highly resistive film. This limitation is avoided by the described oxidative treatment.

The procedure set forth above was followed in a second series of experiments with the exception that the contacts were thermally aged at 150° C for 168 hours prior to the treatment with the oxidizing agent. The results are set forth in Table I.

| Ex. | Resistance After Thermal Aging In Milliohms | Resistance After 1 Minute Boil In 3% $H_2O_2$ In Milliohms | Resistance After 2 Mo. Room Temperature Aging In Milliohms | Resistance After 1 Mo. Room Temperature Aging In Milliohms |
|---|---|---|---|---|
| 1 | 200 | 3.6 | 3.9 | |
| | 20 | 3.4 | 3.6 | |
| | | 3.1 | 3.5 | |
| | | | 3.4 | |
| 2 | 19,000 | 2.9 | | 2.5 |
| | 8 | 3.5 | | 3.9 |
| | | 3.4 | | 3.6 |
| | | | | 2.7 |
| 3 | 4.5 | 1.5 | | |
| | 100.0 | 3.0 | | |
| | | 2.2 | | |
| | | 2.6 | | |
| 4 | 5.5 | 2.8 | | |

-continued

| Ex. | Resistance After Thermal Aging In Milliohms | Resistance After 1 Minute Boil In 3% $H_2O_2$ In Milliohms | Resistance After 2 Mo. Room Temperature Aging In Milliohms | Resistance After 1 Mo. Room Temperature Aging In Milliohms |
|---|---|---|---|---|
| | 100 | 2.9 | | |
| | | 1.7 | | |
| | | 2.1 | | |

Analysis of the data set forth in Table 1 reveals that the oxidation treatment results in a dramatic enhancement in the stability of the contacts so treated during the aging process. Further evidence of this enhancement is shown in Table II below. The contacts employed were similar to those used in the prior examples and were aged for seven days at 150° C.

TABLE II

| Example | Resistance After Aging in Milliohms | Resistance After 1 Min. In Boiling $H_2O_2$ In Milliohms |
|---|---|---|
| 5 | 2.9 | 3.6 |
| | 200 | 3.4 |
| | | 3.1 |
| 6 | 8 | 2.9 |
| | 19,000 | 3.4 |

What is claimed is:

1. Technique for stabilizing the resistance of gold plated electrical contacts which comprises immersing the contact in a boiling oxidizing agent for a time period ranging from 1–3 minutes, the reduction products of the oxidizing agent being water soluble at elevated temperatures.

2. Technique in accordance with claim 1 wherein stabilization is effected prior to thermal aging.

3. Technique in accordance with claim 1 wherein stabilization is effected subsequent to thermal aging.

4. Technique in accordance with claim 1 wherein the oxidizing agent is hydrogen peroxide.

5. Technique in accordance with claim 4 wherein said hydrogen peroxide has a concentration ranging from 1–5 percent, by volume in water.

* * * * *